US007482726B2

(12) United States Patent
Niimi

(10) Patent No.: US 7,482,726 B2
(45) Date of Patent: Jan. 27, 2009

(54) CARBON BRUSH WITH LEAD WIRE FOR USE IN ROTARY ELECTRIC MACHINE

(75) Inventor: Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 486 days.

(21) Appl. No.: 11/272,974

(22) Filed: Nov. 15, 2005

(65) Prior Publication Data

US 2006/0163968 A1 Jul. 27, 2006

(30) Foreign Application Priority Data

Jan. 27, 2005 (JP) ..... 2005-019717

(51) Int. Cl.
*H01R 39/24* (2006.01)

(52) U.S. Cl. ..... 310/249

(58) Field of Classification Search ..... 310/248, 310/249, 251–253
See application file for complete search history.

(56) References Cited

U.S. PATENT DOCUMENTS 5,465,016 A * 11/1995 Mancl et al. ..... 310/71

6,755,882 B2 * 6/2004 Otani et al. ..... 75/231

FOREIGN PATENT DOCUMENTS

JP A 56-035656 4/1981

* cited by examiner

*Primary Examiner*—Dang D Le
(74) *Attorney, Agent, or Firm*—Oliff & Berridge, PLC

(57) ABSTRACT

A carbon brush composed of a brush body and a lead wire is used for supplying electric current to a rotor of a rotary electric machine. The lead wire is made by twisting many thin wire elements each having a diameter smaller than 0.05 mm. A cross-section of the lead wire is made larger than 3 $mm^2$ to give the lead wire a sufficient current capacity. Strength of the lead wire against vibration is improved by using a large number of thin wire elements without sacrificing flexibility. Preferably, a margin length between both ends of the lead wire is provided to allow the lead wire to smoothly follow movements of the brush body slidably contacting a commutator. An amount of a flexure of the lead wire due to the margin length is predetermined so that a stress applied to the wire element does not exceed its permissible fatigue limit.

4 Claims, 2 Drawing Sheets

CARBON BRUSH WITH LEAD WIRE FOR USE IN ROTARY ELECTRIC MACHINE

CROSS-REFERENCE TO RELATED APPLICATION

This application is based upon and claims benefit of priority of Japanese Patent Application No. 2005-19717 filed on Jan. 27, 2005, the content of which is incorporated herein by reference.

BACKGROUND OF THE INVENTION

1. Field of the Invention

The present invention relates to a carbon brush that is used in a rotary electric machine such as a starter for cranking an internal combustion engine.

2. Description of Related Art

A starter including a DC motor is used in an automotive vehicle for cranking an internal combustion engine. A high vibration is imposed on the starter because the starter is directly mounted on the engine. Especially, the starter is subjected to a very high vibration when it is mounted on an engine rotating at a high speed. Therefore, the starter has to be designed to endure a high vibration. Carbon brushes used in the DC motor are also subjected to a high vibration.

A lead wire of the carbon brush is made of twisted copper wires to give a flexibility to the lead wire so that the lead wire is able to follow changes in a length of the carbon brush due to abrasion wear. The lead wire has a margin length between both ends thereof in order to give a certain amount of flexure. When vibration is applied to the lead wire, the lead wire vibrates by the amount of the flexure. There is a possibility that the lead wire is broken due to fatigue caused by such vibration. In particular, the lead wire used in the starter has a limited length for giving flexibility because of a space limitation. Since the starter is exposed to a high vibration, the lead wire vibrates up to an amount of the flexure created by the margin length. This vibration may result in cutting-off of the lead wire.

To cope with this problem, JP-B2-62-32698 proposes an improved lead wire having a high toughness. To improve the toughness of the lead wire, soft copper wire elements and stainless steel wire elements (or piano wire elements) are twisted together to form the lead wire. However, there is an inverse relation between toughness and flexibility. That is, flexibility of the lead wire has to be sacrificed by improving the toughness. If the flexibility of the lead wire decreases, a force pressing the carbon brush against a commutator decreases, resulting in a poor contact between the carbon brush and the commutator.

SUMMARY OF THE INVENTION

The present invention has been made in view of the above-mentioned problem, and an object of the present invention is to provide an improved carbon brush with a lead wire that is able to endure a high vibration while keeping sufficient flexibility.

The carbon brush is used for supplying electric current to a rotor of a rotary electric machine such as a DC motor. The carbon brush is composed of a brush body and a lead wire. A first end of the lead wire is connected to the brush body and the other end thereof is connected to a connector member. The lead wire is made by twisting plural thin wire elements made of soft copper, each wire element having a diameter of 0.05 mm or less. A cross-section of the lead wire is made 3 $mm^2$ or larger to permit a high electric current to flow. By using a large number of thin wire elements, the lead wire endures a high vibration load while keeping sufficient flexibility.

It is preferable to provide a certain margin length between the first and second ends of the lead wire to thereby give a flexure to the lead wire. Because of the flexure, the lead wire easily follows movement of the brush body slidably contacting a commutator. In particular, the lead wire smoothly follows changes in a length of the brush body due to its abrasion wear. An amount of the flexure is predetermined so that a stress applied to the wire element, when a load corresponding to acceleration of 150 G is imposed on the lead wire, does not exceed a permissible fatigue limit of the wire element. The first end of the lead wire is connected to the brush body by integrally molding with the brush body. The second end of the lead wire is connected to the conductive member by brazing to avoid any damage on the thin wire elements by heat. The brush body is made of carbon that includes a metallic component having high electrical conductivity such as copper powder.

The carbon brush of the present invention is advantageously applied to a DC motor used in a starter for cranking an internal combustion engine. Though the starter is vibrated by a high acceleration such as 150 G, the lead wire of the carbon brush of the present invention can be used without being damaged. Other objects and features of the present invention will become more readily apparent from a better understanding of the preferred embodiment described below with reference to the following drawings.

DETAILED DESCRIPTION OF THE PREFERRED EMBODIMENT

Figure 1:
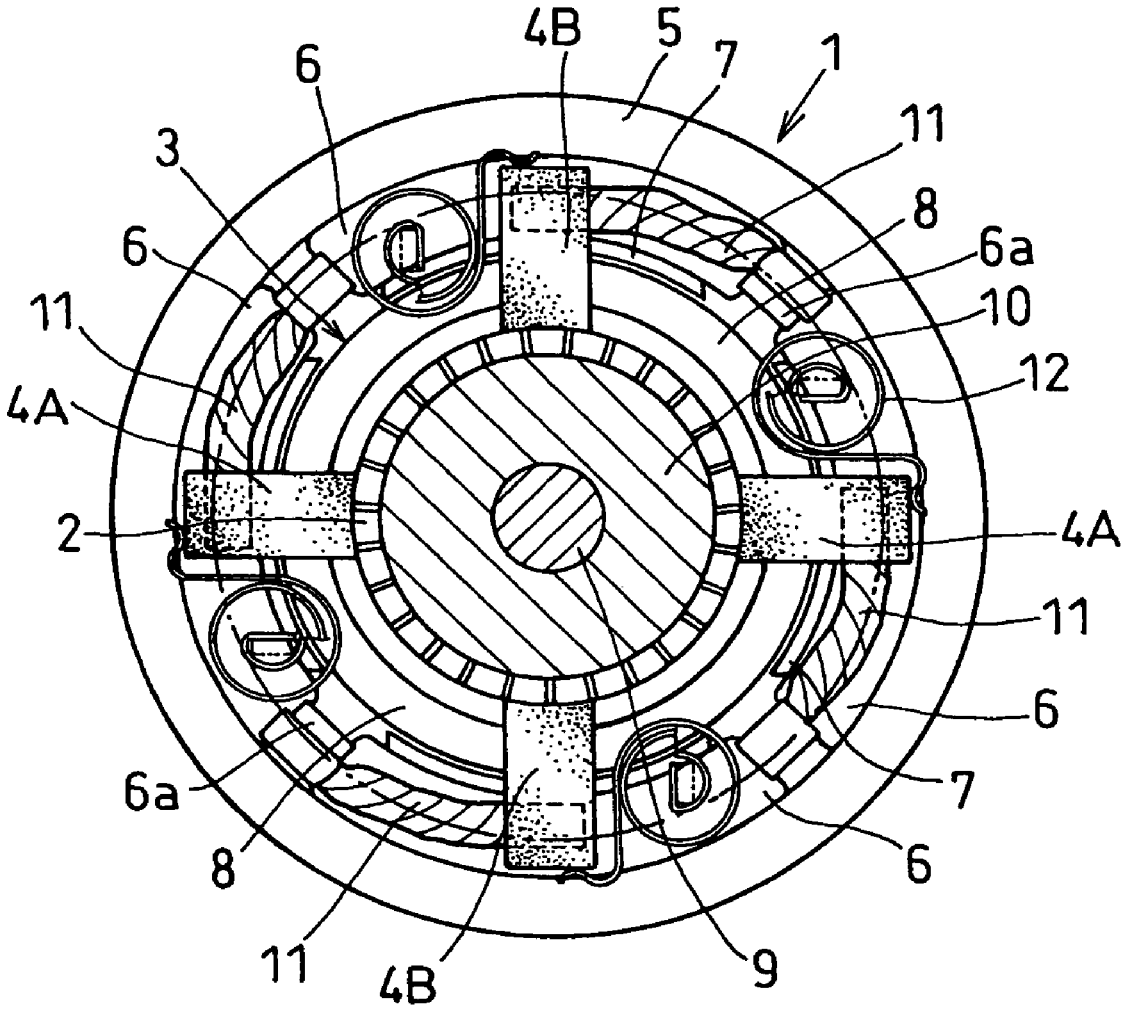
FIG. 1 is a plan view showing an inside of a DC motor, viewed from its axial end with a rear cover removed.

A preferred embodiment of the present invention will be described with reference to accompanying drawings. A DC motor 1 shown in FIG. 1 is used in a starter for cranking an internal combustion engine. The DC motor 1 is composed of a cylindrical stator for generating a magnetic field therein and a rotor functioning as an armature rotating in the magnetic field.

The magnetic field is generated by a field winding 6 wound around pole cores 7 fixed to an inner bore of a cylindrical yoke 5. The yoke 5 forming a magnetic path for the magnetic field also serves as a housing of the DC motor 1. One end of the field winding 6 is connected to a connection bar (not shown), and the other end thereof is led out to a connecting portion 6*a*. The armature 3 has an armature winding 8 wound on an armature core connected to an armature shaft 9 and a commutator 2 for supplying electric current to the armature winding 8. The armature shaft 9 is rotatably supported by bearings (not shown) disposed at both ends of the armature shaft 9. The commutator 2 having plural segments connected to the armature winding 8 is connected to the armature shaft 9 via an insulator 10.

Carbon brushes 4 sildably contact the commutator 2 for supplying electric current to the armature winding 8. The carbon brushes 4 consist of a pair of plus brushes 4A connected to a high potential side and another pair of minus brushes 4B connected to a low potential side. Each carbon brush 4 is composed of a brush body 4*a* and a lead wire 11 (refer to FIG. 2). The brush body 4*a* is made of carbon containing a conductive material such as copper powder. One end of the lead wire 11 is electrically and mechanically connected to an upper side of the brush body 4*a* by molding together with the carbon body 4*a*. The other end of the lead wire 11 is electrically and mechanically connected to a conductor member in the DC motor 1. As shown in FIG. 1, carbon brushes 4 are disposed on an outer periphery of the commutator 2 and pushed against the outer periphery by brush springs 12.

The other end of the lead wire 11, one end of which is connected to the plus brush 4A, is connected to a connecting portion 6*a* of the field winding 6. The other end of the lead wire 11, one end of which is connected to the minus brush 4B, is connected to a metallic plate that is grounded. Those connections are made by brazing in use of a solder such as a phosphorus-copper solder or a silver solder.

Figure 2:
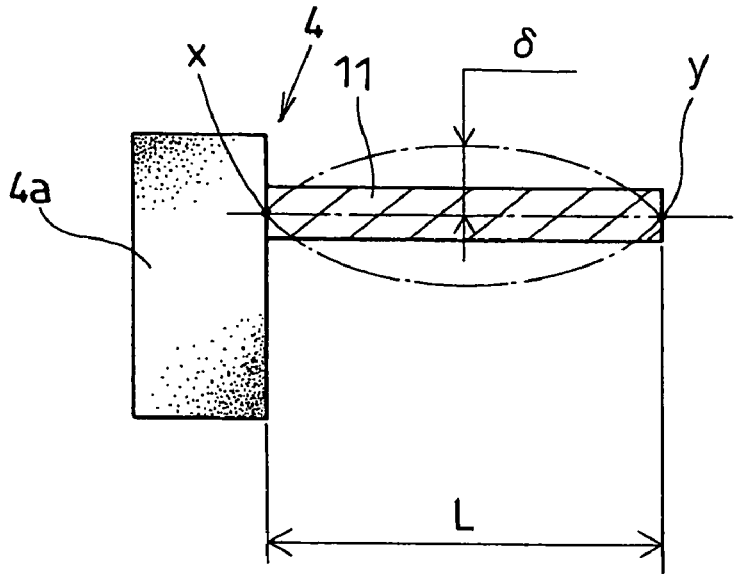
FIG. 2 is a side view showing a carbon brush having a lead wire.

The lead wire 11 is composed of twisted soft copper wire elements and has a cross-sectional area of 3 $mm^2$ or larger. Each wire element has a diameter of 0.05 mm or smaller. As shown in FIG. 2, the lead wire has a margin length between both ends thereof, i.e., an actual length of the lead wire 11 is longer than a distance between two points x and y. Accordingly, the lead wire 11 has a flexure δ which makes the lead wire 11 easily follow the abrasion wear of the carbon brush 4. The length of the lead wire 11 is set to such a length that forms a predetermined amount of flexure δ. The amount of the predetermined flexure δ is so set that a stress applied to the wire element does not exceed a permissible fatigue limit of the wire element when a load corresponding to an acceleration of 150 G due to vibration is imposed on the lead wire 11.

Figure 3:
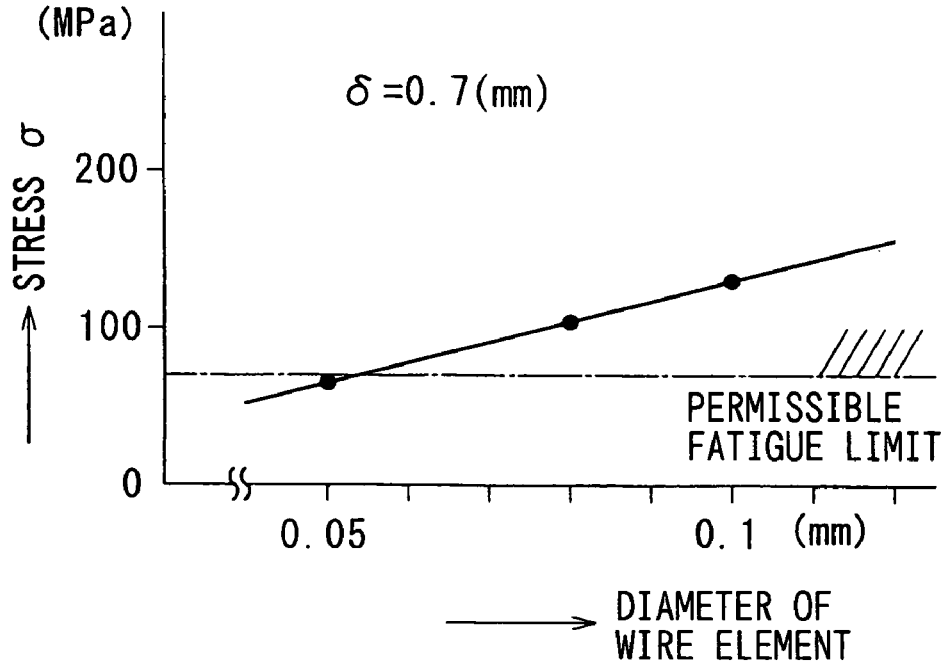
FIG. 3 is a graph showing a relation between a diameter of a wire element and a stress generated in the wire element by vibration.

The stress applied to the wire element of the lead wire 11 can be decreased by reducing the diameter of the wire element, thereby deducing a cross-section coefficient of the wire element. With reference to FIGS. 2 and 3, a relation between the stress σ applied to the wire element and the diameter d of the wire element will be explained. As shown in FIG. 2, the lead wire 11 can be represented by a beam supported between the points x and y. A maximum amount of flexure δ of the beam (the lead wire 11), when a load W is imposed at a middle point between x and y, is expressed by the following formula:

$$\delta=\beta\cdot W\cdot L^3/(E\cdot I),$$

where L is a distance between x and y, E is a coefficient of a longitudinal elasticity, I is a secondary cross-sectional moment ($I=\pi/64\cdot d^4$), d is a diameter of the beam, and β is a constant. The stress σ applied to the beam, assuming that the beam has a round cross-section of a diameter d, is expressed by the following formula:

$$\sigma=M/Z=W\cdot L/Z,$$

where M is a moment, Z is a cross-section coefficient ($Z=\pi/32\cdot d^3$) The following formula can be derived from the above two formulae:

$$\sigma=\delta\cdot E\cdot d/(\beta\cdot 2\cdot L^2)$$

From this formula, it can be said that the stress σ applied to the wire element is proportional to the diameter d of the wire element if the amount of flexure δ is fixed to a predetermined value.

The stress σ applied to the wire element versus the diameter d of the wire element is plotted in FIG. 3, when the amount of flexure δ is set to 0.7 mm. The stress σ increases in proportion to the diameter d of the wire element and exceeds its permissible fatigue limit when the diameter d becomes larger than 0.05 mm. Therefore, in the embodiment described above, the wire element having the diameter smaller than 0.05 mm is used.

As described above, the lead wire 11 of the present invention is formed by using a large number of wire elements each having a small diameter. More particularly, the lead wire 11 having a cross-sectional area of 3 $mm^2$ or larger is made by twisting a number of soft copper wire elements each having a diameter of 0.05 mm or smaller. In this manner, the lead wire 11, which is flexible and strong while allowing a large amount of current to flow, is made. If the toughness of the lead wire is increased in the manner as suggested by the prior art discussed above, JP-B2-62-32698, the flexibility of the lead wire is sacrificed. It becomes difficult for the lead wire to follow abrasion wear of the brush. Further, the brush body is not properly pushed against the commutator by the brush spring. According to the present invention, the lead wire can be made sufficiently strong without sacrificing the flexibility.

The amount of flexure δ (the margin length) of the lead wire 11 is set to a predetermined amount so that the lead wire 11 is able to endure a high acceleration due to vibration, the highest level of which is about 150 G. The carbon brush according to the present invention is not damaged by such a high vibration.

One end of the lead wire 11 is connected to the brush body 4*a* by integral molding, and the lead wire 11 is formed with a larger number of element wires (compared with a conventional lead wire in which the element wire having a diameter of, e.g., 0.1 mm is used). Therefore, a contact area between one end of the lead wire 11 and the brush body 4*a* can be made larger, thereby reducing the contact resistance at the connecting portion. The other end of the lead wire 11 is connected to the conductive member (the connecting portion 6*a* or the metallic plate) by brazing. Therefore, the wire elements having the small diameter are not damaged by heat generated in a process of connection. If the other end of the lead wire 11 were connected to the conductive member by welding or the like, the lead wire would be damaged by heat.

The starter having the DC motor, in which the carbon brushes 4 according to the present invention are used, is able to endure a high vibration of an internal combustion engine. The starter can be mounted on an engine generating a high vibration without making any special changes therein. Though the carbon brushes 4 according to the present invention are applied to the DC motor 1 of the starter in the foregoing embodiment, it is, of course, possible to apply the carbon brushes 4 to other rotary electric machines. Though the magnetic field in the stator is generated by the field winding 6 in the foregoing embodiment, the magnetic field may be formed by permanent magnets.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter for cranking an internal combustion engine, comprising:

a direct current motor;

a carbon brush that is used in the direct current motor, the carbon brush comprising:

a brush body; and a lead wire, one end of which is electrically and mechanically connected to the brush body, and the other end of which is electrically and mechanically connected to a conductor member, wherein:

the lead wire is composed of twisted soft copper wire elements, the lead wire having a cross-section larger than 3 $mm^2$, each wire element having a diameter smaller than 0.05 mm, the lead wire has a margin length between both ends thereof, the margin length forming a flexure of the lead wire, and an amount of the flexure is predetermined so that a stress applied to the wire element, when a load corresponding to acceleration of 150 G is imposed on the lead wire, does not exceed a permissible fatigue limit of the wire element.

2. The starter as in claim 1, wherein:

the brush body is made of carbon that includes a metallic component having a high electrical conductivity; and the one end of the lead wire is integrally molded with the brush body.

3. The starter as in claim 2, wherein:

the other end of the lead wire is connected to the conductor member by brazing.

4. The starter as in claim 2, wherein:

the metallic component is copper powder.

* * * * *